US006135556A

United States Patent [19]

Chu et al.

[11] Patent Number: 6,135,556

[45] Date of Patent: Oct. 24, 2000

[54] SEAT ADJUSTMENT MECHANISM

[75] Inventors: Zooey Chu, Grand Rapids, Mich.; Harald Wurl, Kleinsendelbach; Hermann Bock, Pyrbaum, both of Germany

[73] Assignee: Teknion Furniture Systems Inc., Downsview, Canada

[21] Appl. No.: 09/092,755

[22] Filed: Jun. 5, 1998

[51] Int. Cl.[7] ..... A47C 1/06

[52] U.S. Cl. ..... 297/337; 248/429

[58] Field of Search ..... 297/337, 344.1; 248/292.12, 429

[56] References Cited

U.S. PATENT DOCUMENTS

| | | | |
|---|---|---|---|
| 871,755 | 11/1907 | Flindall | 297/260.1 X |
| 1,065,280 | 6/1913 | Stanger et al. | 248/422 |
| 1,693,120 | 11/1928 | Rhyner . | |
| 1,893,531 | 1/1933 | Ball | 384/34 |
| 2,310,346 | 2/1943 | Bell | 155/94 X |
| 2,500,316 | 3/1950 | Kramer | 155/14 X |
| 2,715,433 | 8/1955 | Dolgorukov | 155/14 X |
| 3,219,386 | 11/1965 | Simons | 297/309 |
| 3,286,971 | 11/1966 | Walter et al. | 248/429 X |
| 4,401,343 | 8/1983 | Schmidt | 297/284 |
| 4,648,656 | 3/1987 | Kimura | 297/337 |
| 4,796,951 | 1/1989 | Tamura et al. | 297/337 |
| 5,035,466 | 7/1991 | Mathews et al. | 297/337 |
| 5,349,878 | 9/1994 | White et al. | 74/89.14 X |
| 5,431,360 | 7/1995 | Yu | 244/122 R |
| 5,588,708 | 12/1996 | Rykken et al. | 297/423.2 X |
| 5,782,536 | 7/1998 | Heidmann et al. | 297/440.15 X |
| 5,884,887 | 3/1999 | Garelick et al. | 248/423 X |
| 5,988,749 | 3/1999 | Williams | 297/337 |
| 6,010,194 | 1/2000 | Cykon | 297/440.22 X |

FOREIGN PATENT DOCUMENTS

| | | | |
|---|---|---|---|
| 2211575 | of 0000 | Canada . | |
| 1076944 | 5/1980 | Canada | 155/49 |
| 1312815 | 1/1993 | Canada | 155/34 |
| 2184164 | 7/1996 | Canada | 1/22 |

OTHER PUBLICATIONS

Lux Steel Web Page http://www.backbenimble.com/lux_steel/TSK1210a.htm.

Photographs of product shown on above web page, 2 sheets.

*Primary Examiner*—Peter M. Cuomo
*Assistant Examiner*—Brian H. Buck
*Attorney, Agent, or Firm*—Laff, Whitesel & Saret, Ltd.

[57] ABSTRACT

A chair comprises a longitudinally extending seat; a support member for supporting the seat at an elevated height; a slide member fixedly mounted to one of the seat and the support member; a housing positioned between the seat and the support member and fixedly mounted to the other of the seat and the support member, the housing having a cavity for slidably receiving the slide member, the slide member mounted for longitudinal movement forward and rearward with respect to the housing; and, an adjustment member mounted in the housing and drivingly connected to the slide member, whereby movement of the adjustment member in a first direction causes the seat to move forwardly and movement of the adjustment member in the opposite direction causes the seat to move rearwardly.

28 Claims, 6 Drawing Sheets

SEAT ADJUSTMENT MECHANISM

FIELD OF THE INVENTION

This invention relates to an adjustment mechanism for a seat. In particular, this invention relates to an adjustment mechanism whereby the seat of a chair or the like may be moved longitudinally forward or rearward with respect to the support on which the seat of the chair is positioned.

BACKGROUND OF THE INVENTION

Rhyner (U.S. Pat. No. 1,693,120), Kimura (U.S. Pat. No. 4,648,646) and Tamura et al (U.S. Pat. No. 4,796,591) each disclose the use of a rack and pinion to adjust the position of a car seat. Rhyner discloses an adjustment mechanism comprising a hand wheel mounted on a shaft on which pinions are provided. Racks are provided on opposed sides of the bottom of the seat. Upon turning the hand wheel, the pinions rotate causing the cat seat, to which the rack is mounted, to move forwardly or rearwardly. This design is disadvantageous for use with an office chair or the like as it uses two widely spaced apart racks to provide transverse stability to the seat.

Kimura and Timura et al each also disclose the use of spaced apart racks. In addition, these references disclose multiple support and linking members between the seat and the floor of the car. The mechanism discloses a plurality of parts which are complicated to manufacture and are not suitable for use with an office chair or the like.

Ambasz (Canadian Patent No. 1,076,944) discloses a chair which operates on the principle of independent forward and backward movement of the seat and tilting of the back such that a chair may automatically adopt a configuration that will provide excellent anatomical support to a person seated in the chair. To this end, Ambasz discloses a seat which has on its underside, adjacent to the centre and removed from the sides, a pair of elongated sleeves of uniform internal cross-section which extend lengthwise. The sleeves are in telescoping and sliding relation on the seat support such that the seat is slidable forwardly and rearwardly. The seat is spring-loaded toward the rearward most position. Accordingly, one disadvantage of this design is that it does not permit the operator to fix the seat in a pre-set position with respect to the chair back.

Matthews et al (U.S. Pat. No. 5,035,466) discloses an ergonomic chair wherein the seat support member is movable between a forward seated position and a rearward seated position. The mounting means for the seat includes a channel having a generally dovetail shaped configuration and a runner having a mating of dovetail shaped configuration that slidably engages the channel. As with Ambasz, the mounting means also includes means for biasing the seat support member toward the rearward position. Thus, the user may selectively apply force while seated in the chair to adjust and retain the position of the seat support member in a desired position between the rearward and forward position of the seat. Upon standing, the user removes the external force from the seat and the contraction force of the biasing means (i.e. A spring) will urge the runner back towards its original rearward seated position. Thus, one disadvantage of Matthews et al is that the chair will not maintain itself in a pre-selected position while the user stands.

Olsen et al (U.S. Pat. No. 5,542,743) discloses a chair in which the seat member is movable with respect to the back-rest of the chair. The adjustment mechanism comprises a pair of parallel spaced tubular members telescopically received in the control bracket. The seat may be fixed in position by a clamping bar which clamps the tubular members to the control bracket. Accordingly, one disadvantage of this design is that, when the clamp is removed, there is no restriction on the movement of this seat with respect to the chair back. Accordingly, the seat would become free floating.

Accordingly, previous disclosures have shown seat adjustment mechanisms for chairs which do not provide adequate controlled adjustment of the position of the seat with respect of the seat support. In addition, prior designs have incorporated constructions which are difficult to employ and/or which are complicated to construct.

SUMMARY OF THE INVENTION

In accordance with the present invention, there is provided a chair comprising a longitudinally extending seat; a support member for supporting the seat at an elevated height; a slide member fixedly mounted to one of the seat and the support member; a housing positioned between the seat and the support member and fixedly mounted to the other of the seat and the support member, the housing having a cavity for slidably receiving the slide member, the slide member mounted for longitudinal movement forward and rearward with respect to the housing; and, an adjustment member mounted in the housing and drivingly connected to the slide member, whereby movement of the adjustment member in a first direction causes the seat to move forwardly and movement of the adjustment member in the opposite direction causes the seat to move rearwardly.

In accordance with the present invention, there is also provided a seat adjustment mechanism for a chair having a longitudinally extending seat and a support member for supporting the seat at an elevated height, the seat adjustment mechanism comprising a slide member for receiving thereon one of the seat and the support member; a housing positionable between the seat and the support member for receiving thereon the other of the seat and the support member, the housing having a cavity for slidably receiving the slide member, the slide member mounted for longitudinal movement forward and rearward with respect to the housing; and, an adjustment member mounted in the housing and drivingly connected to the slide member.

In one embodiment, the cavity has a pair of longitudinally extending side walls. The transverse distance between the side walls is slightly larger than the transverse width of the slide member to permit the slide member to move longitudinally with respect to the side wall but to prevent transverse motion of the slide member with respect to the housing.

In another embodiment, the cavity has a plurality of longitudinally extending grooves and the slide member has slide elements that are received in the grooves.

In another embodiment, the cavity has a plurality of longitudinally extending openings, the slide member has slide elements that are received in the openings and securing members extend from the slide member to the one of the seat and the support member.

The housing may comprise a seat mounting member and a removable cover each of which is provided with a plurality of tracks, with the tracks of the seat mounting member aligning with the tracks of the removable cover to define a plurality of pairs of tracks whereby each of the pairs of tracks receives a slide element therein.

In one embodiment, the seat is connected to the housing and support member is connected to slide member. In another embodiment, the support member is connected to the housing and seat is connected to slide member.

In one embodiment, the adjustment member comprises a shaft and the housing includes bearing surfaces for rotatably receiving the shaft. Preferably, the housing comprises a seat mounting member and a removable cover, and the bearing are surfaces provided on each of the seat mounting member and the removable cover. Alternately, or in addition, the adjustment member may be drivingly connected to the slide member by rack and pinion drive members.

In one embodiment, the chair has a chair back connected to one of the slide member and the support member whereby adjustment of the adjustment member causes the seat to move with respect to the chair back.

The chair may have a lock mechanism having a locked position in which the adjustment member is fixed in position and an unlocked position in which the adjustment member may be moved to adjust the position of the seat. The locking mechanism may comprise a biasing member to bias the locking member in the locked position.

The locking mechanism may comprise a first engagement member connected to the housing and a second engagement member connected to the adjustment member whereby engagement of the first and second engagement members defines the locked position. Alternately, or in addition, the slide member may comprise a rack, the adjustment member may comprise a shaft having a pinion, and the locking mechanism may comprise a first engagement member connected to the housing and the pinion whereby engagement of the first engagement member and the pinion defines the locked position. Preferably, the pinion moves transversely between the locked and the unlocked positions and the pinion is biased to the locked position by a biasing member.

One advantage of the instant invention is that it provides a seat adjustment mechanism which is simple to construct and, at the same time, is also reliable. Further, it is of a relatively compact size which is well adapted to be fitted between the tilt control mechanism of a pedestal chair and the seat of the pedestal chair.

A further advantage of the instant invention is that the position of the seat may be easily adjusted by turning the adjustment member while a user is seated in the chair. This ease of use is further facilitated by incorporating the locking mechanism as part of the adjustment member. In the preferred embodiment, the adjustment member is moved between the locked position and the in-use (unlocked) position by the user, while seated in the chair, pushing transversely inwardly on the adjustment member. The user may then rotate the adjustment member clockwise or counter-clockwise to adjust the position of the seat while they are still seated in the chair. Accordingly, the user requires the use of only one hand and may operate the adjustment member while still comfortably seated in the chair.

DESCRIPTION OF THE DRAWINGS

These and other advantages of the instant invention will be more fully and completely understood in association with the following description of the preferred embodiment of the invention in which.

DESCRIPTION OF PREFERRED EMBODIMENT

Figure 1:
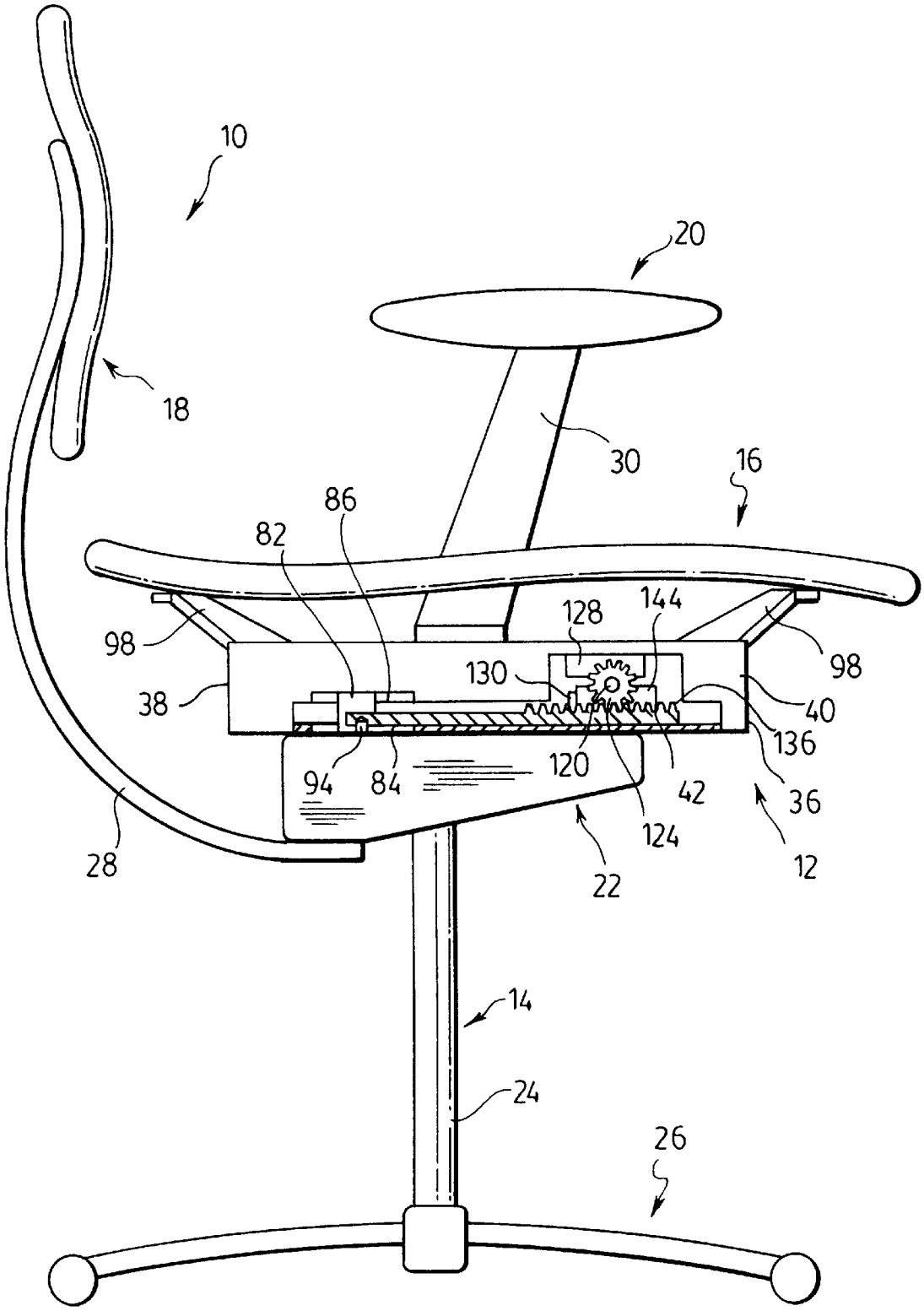
FIG. 1 is a side elevation view of a chair according to the instant invention with the seat adjustment mechanism shown in cross-section along the line 1—1 in FIG. 6.
Figure 2:
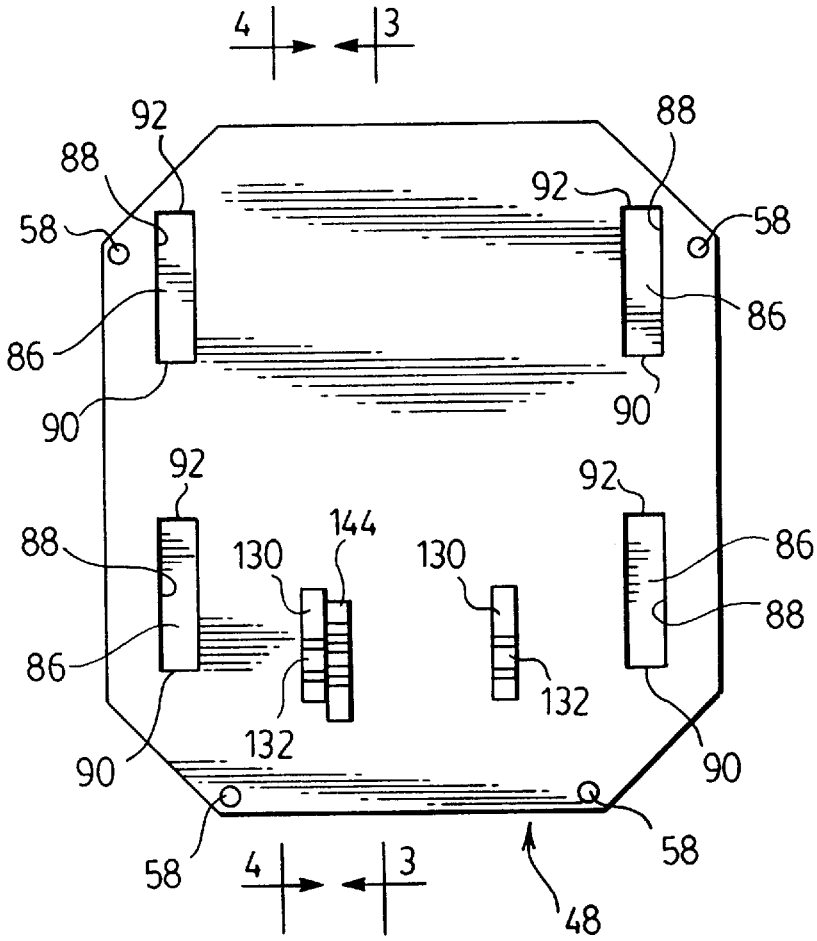
FIG. 2 is a plan view of the interior surface of the cover plate of the housing of the slide mechanism shown in FIG. 1.

Referring to FIG. 1, chair 10 comprises a seat adjustment mechanism 12, a support member 14, a seat 16, a back rest 18, arms 20 and tilt mechanism 22.

Chair 10 may be a seating unit of any general type, shape or configuration. As shown in the preferred embodiment, chair 10 is an office chair or a task chair where a person may be seated for an extended period of time while working.

Support member 14 may be any support member for supporting seat 16 at an elevated height. Preferably, support member 14 comprises a longitudinally extending cylinder 24 (which, more preferably, is a pneumatic cylinder) having a wheeled base 26.

Chair 10 may have a back rest 18. Back rest 18 may be of any shape or configuration known in the art. Preferably, back rest 18 is mounted to support member 14 or, as shown in FIG. 1, to tilt mechanism 22 by any means known in the art, such as by means of a curved bracket 28 which is attached by, eg. screws, to the bottom surface of tilt mechanism 22. More preferably, back rest 18 is mounted to tilt mechanism 22. By connecting back rest 18 to a portion of the chair beneath seat adjustment mechanism 12, the position of back rest 18 is affixed to a portion of chair 10 which will remain stationary while the position of seat 16 is adjusted. Therefore, seat 16 may be moved forwardly or rearwardly with respect to back rest 18 by means of seat adjustment mechanism 12. It will be appreciated that bracket 28 may also be affixed to the portion of the seat adjustment mechanism 12 which remains fixed in position with respect to tilt mechanism 22. It will also be appreciated that back rest 18 may have independent controls to adjust, eg., its position with respect to support member 14, its height or its inclination.

Figure 11:
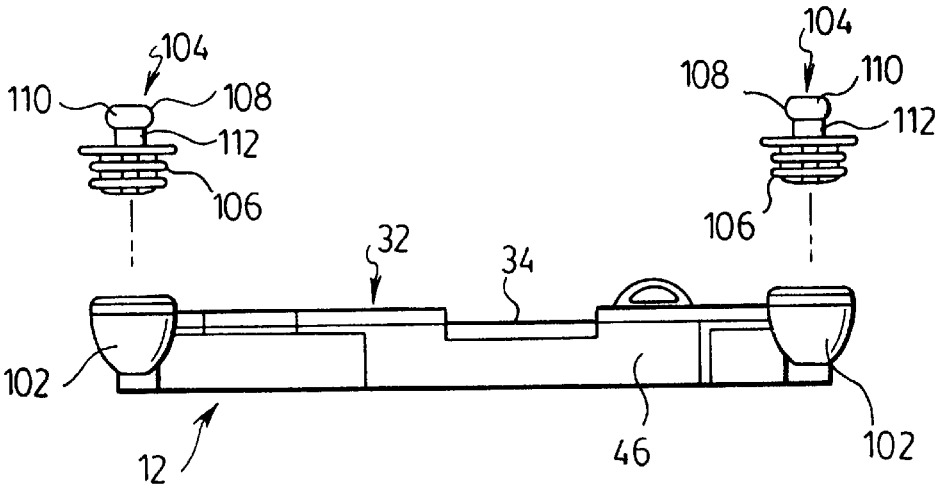
FIG. 11 is a side view of an alternate seat support according to the instant invention.

In a preferred embodiment, chair 10 is also provided with arms 20. Arms 20 may be transversely spaced apart on each side of seat 16. Each arm 20 may be affixed to chair 10 via a bracket 30. Arms 20 may be mounted to chair 10 so as to move with seat 16, in which case bracket 30 may be affixed to the portion of seat adjustment mechanism 12 which moves with seat 16. For example, as shown in FIG. 11, seat adjustment mechanism 12 may have an upper surface 32 which is provided with a recess 34 which is sized and adapted to receive therein, and have affixed thereto, the lower portion of bracket 30. Thus, each arm 20 may be affixed to the portion of the seat adjustment mechanism 12 which is stationary with respect to seat 16. Alternately, the lower portion of bracket 30 may be affixed to support member 14, tilt mechanism 22 or the portion of seat adjustment mechanism 12 which is fixed in position with respect to tilt mechanism 22 so that as seat 16 is moved forwardly and rearwardly, the position of arms 20 with respect seat 16 varies.

Seat adjustment mechanism 12 is positioned between support member 14 and seat 16. Preferably, as is known in the art and as is shown in FIG. 1, support member 14 is mounted to a tilt mechanism 22 which may be any mechanism known in the art which will permit seat 16 to rock forwardly or rearwardly. Such tilt/control mechanisms are known in the art and all such mechanisms may be incorporated into chair 10. It will be appreciated that if a tilt mechanism 22 were not provided, support member 14 may be connected directly to seat adjustment mechanism 12 in the same manner as is described for affixing tilt mechanism 22 to seat adjustment mechanism 12.

Seat adjustment mechanism 12 comprises a housing 40 and slide member 42. Housing 40 has a frontward end 36, a rearward end 38 and a cavity for slidable receiving slide member 42. Housing 40 may be of any particular shape and configuration and is preferably of a compact shape which may be unobtrusively positioned beneath seat 16.

Slide member 42 is mounted in housing 40 for longitudinal movement forwardly and rearwardly with respect to housing 40. Further, slide member 42 is mounted in housing 40 so as to be fixed transversely in position with respect to housing 40. Accordingly, as slide member 42 moves longitudinally forwardly or rearwardly with respect to housing 40, it will not move transversely side to side. Seat adjustment member 12 also has an adjustment member 44 mounted in the housing 40 and drivingly connected to slide member 42.

Figure 5:
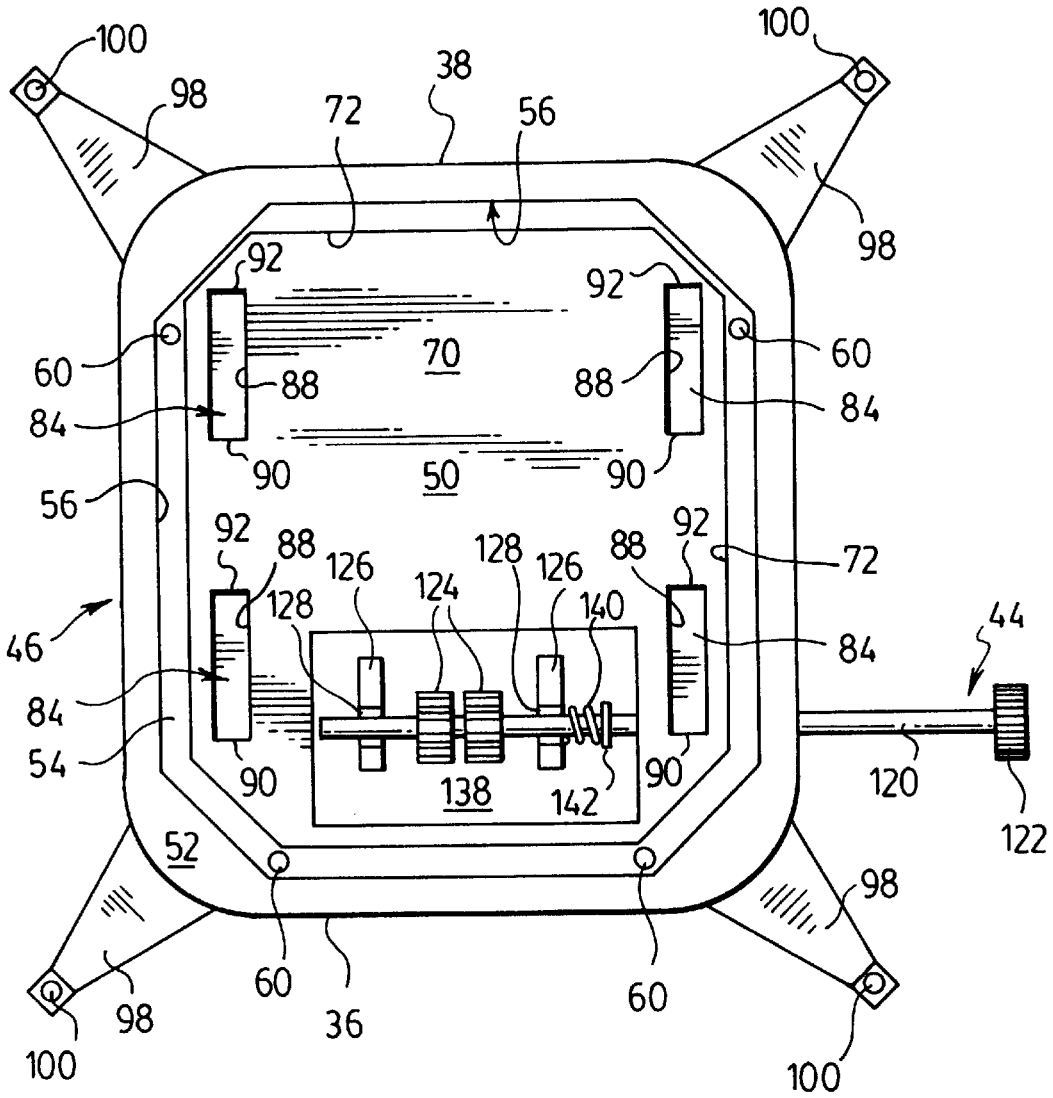
FIG. 5 is a plan view of the interior of the seat support of the seat adjustment mechanism shown in FIG. 1 with the adjustment member mounted therein.

In order to assemble seat adjustment mechanism 12, housing 40 is provided with an access port so that adjustment member 44 and slide member 42 may be mounted therein. Accordingly, as shown in the preferred embodiment, housing 40 comprises seat support 46 and cover plate 48. Pursuant to this construction, seat support 46, when viewed from the bottom in plan view as shown in FIG. 5, has a cavity 50 for receiving slide member 42 (see FIG. 6). Preferably, cover plate 48 is releasably secured to seat support 46.

Housing 40 is configured so that slide member 42 is fixed in position in cavity 50 to slide along tracks which are provided in housing 40. In the preferred embodiment seat support 46 and cover plate 48 are configured so that slide member 42 is sandwiched therebetween to vertically fix slide member 42 in position.

Figure 6:
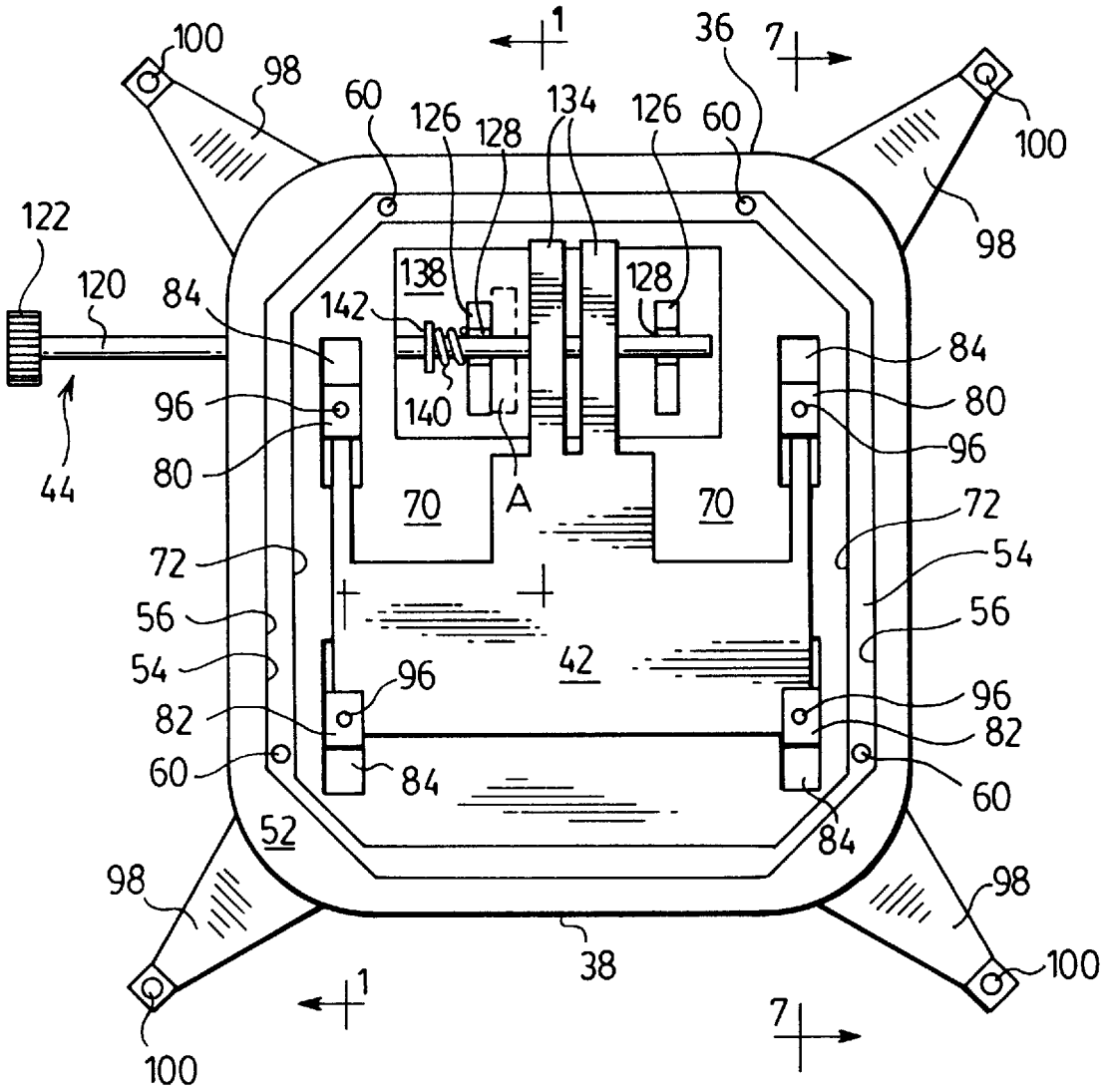
FIG. 6 is a plan view of the interior of the seat support of the seat adjustment mechanism shown in FIG. 1 with the adjustment member and the slide member positioned therein.

Accordingly, as shown in FIGS. 5 and 6, seat support 46 has a bottom surface 52 and a shelf 54 positioned inward thereof to provide an abutment surface on which cover plate 48 may be seated. Shelf 54 is recessed inwardly into seat support 46. Vertically extending side walls 56 extend from bottom surface 52 to shelf 54. Cavity 50 has an inner surface 70 which is recessed with respect to shelf 54. Vertically extending side walls 72 extend from shelf 54 to inner surface 70. The height of vertically extending side walls 72 and vertically extending side walls 56 are selected such that, when slide member 42 is positioned in cavity 50 and cover plate 48 is secured on shelf 54, slide member 42 may move forwardly and rearwardly in cavity 50 with respect to housing 40.

Cover plate 48 may be secured, and preferably releasably secured, in position on shelf 54 by any means known in the art, such as by means of screws (not shown). Accordingly, cover plate 48 may be provided with screw holes 58 and shelf 54 may be provided with mating screw holes 60. Thus, when cover plate 48 is positioned on shelf 54 such that screw holes 58 and 60 align, and screws, or the like, are inserted through screw holes 58 into screw holes 60, cover plate 48 is removably secured to seat support 46 with a cavity 50 extending therebetween.

To mount slide member 42 in housing 40 so that slide member 42 is fixed transversely in position with respect to housing 40, housing 40 may be provided with a path in which slide member 42 moves longitudinally yet restrains transverse side to side motion of slide member 42. For example, the transverse distance between side walls 72 may be slightly larger than the transverse width between side walls 68 of slide member 42 to permit slide member 42 to move longitudinally with respect to side walls 72 but to prevent transverse motion of slide member 42 with respect to housing 40. Alternately, or in addition, housing 40 may be provided with tracks which may have side walls which engage elements of slide member 42 thus preventing transverse motion of slide member 42 with respect to housing 40.

Figure 8:
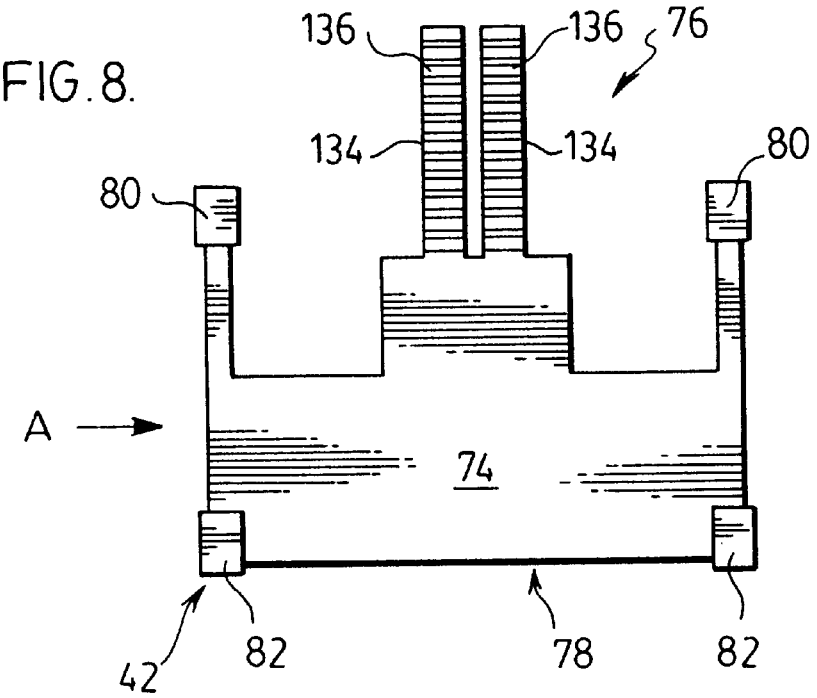
FIG. 8 is a top plan view of the slide member of FIG. 7.
Figure 9:
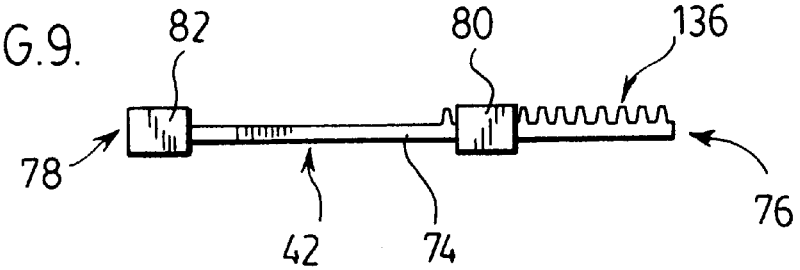
FIG. 9 is a side view of the slide member of FIG. 8 shown in the direction of arrow A of FIG. 7.
Figure 10:
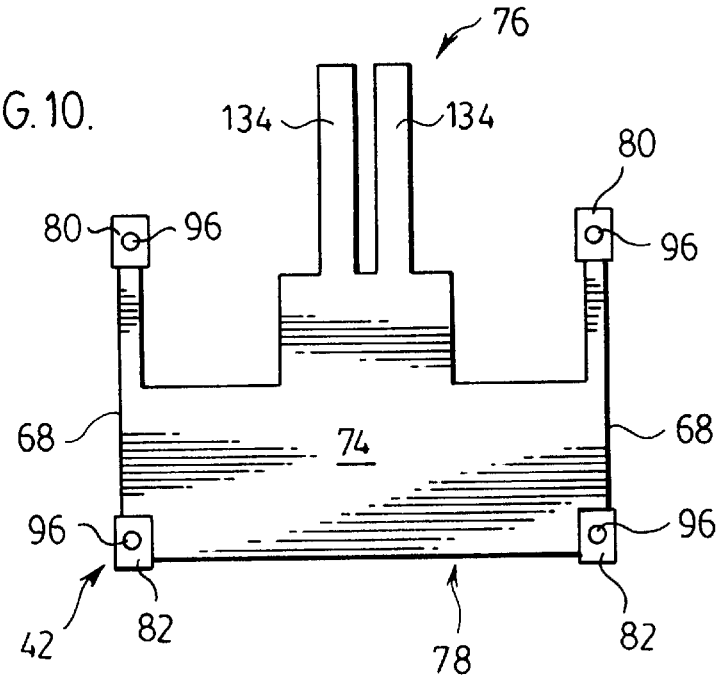
FIG. 10 is a bottom plan view of the slide member of FIG. 6.

Referring to the drawings, in the preferred embodiment, slide member 42 comprises a plate 74 having a forward end 76 and a rearward end 78. Plate 74 is provided with a plurality of slide elements along side walls 68 which enable slide member 42 to slide or glide longitudinally within cavity 50. Referring to FIGS. 8 and 10, slide member 42 may have a plurality of forward slide elements 80 and a plurality of rearward slide elements 82. Preferably, slide member 42 is provided with two forward slide elements 80 which are positioned on opposed transverse sides of plate 74 and two rearward slide elements 82 which are positioned on opposed transverse sides of plate 74. Thus, plate 74 is provided with a pair of forward and rearward slide elements 80 and 82 on each transverse opposed side of plate 74. Plate 74 preferably comprises an integral member which is made from a rigid member such as steel or which may also be made from plastic. Slide elements 80 and 82 may be formed integrally as part of plate 74 or they may be affixed to plate 74 by any means known in the art.

Figure 7:
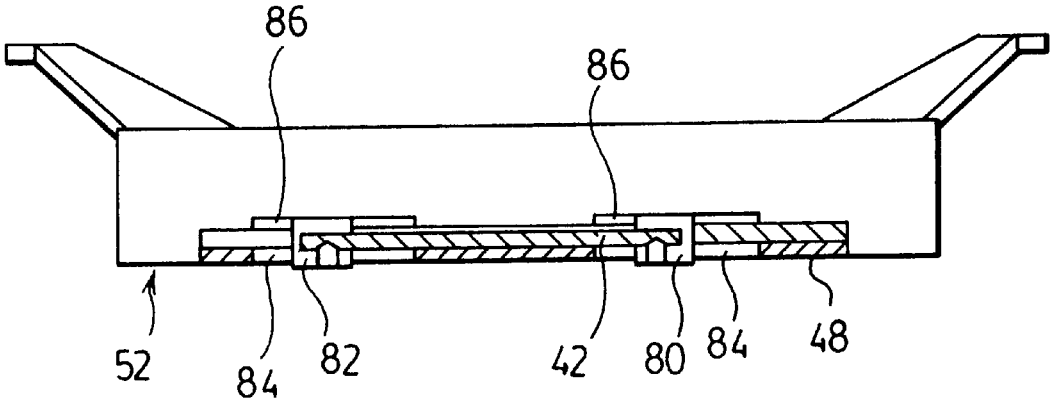
FIG. 7 is a cross section of the seat adjustment mechanism along the lines 7—7 in FIG. 6.

In the preferred embodiment, inner surface 70 is provided with a plurality of grooves 84 for receiving slide elements 80 and 82. Similarly, cover plate 48 is provided with a plurality of grooves 86 which are spaced from, but aligned with grooves 84 of inner surface 70. Accordingly, a pair of groves 84 and 86 is provided for each slide element 80 and 82. Grooves 84 and 86 may be recessed surfaces which have side walls that define a track for slide elements 80, 82. Alternately, grooves 84 and 86 may be on raised platforms which are mounted to inner surface 70 and the inner surface of cover plate 48. Preferably, as shown in FIG. 7, grooves 84 and 86 are openings having side walls 88 in inner surface 70 and cover plate 48 through which slide elements 80 and 82 partially extend. Thus, side walls 88 of grooves 84 and 86 provide abutment surfaces which prevent transverse motion of slide member 42 with respect to housing 40.

As will be appreciated, housing 40 has a pair of rearwardly positioned grooves 84, 86 for receiving rearward slide elements 82 and a pair of forward grooves 84, 86 for receiving forward slide elements 80. Each groove 84, 86 has a rearward end 90 and a forward end 92. Preferably, the longitudinal distance between rearward end 90 of the rearward grooves and rearward end 90 of the forward grooves is the same as the longitudinal distance between forward slide elements 80 and rearward slide elements 82. Accordingly, when slide member 42 is in the rearward position in housing 40, each slide element 80, 82 is adjacent the rearward end 90 of the respective grooves 84, 86. Similarly, when slide element 42 is at its forward position in housing 40, each slide element 80, 82 is adjacent forward end 92 of the respective grooves 84, 86.

As will be appreciated, slide member 42 is fixedly mounted to one of seat 16 and tilt mechanism 22. Accordingly, the housing 40 is mounted to the other of seat 16 and tilt mechanism 22. As shown in FIG. 1, tilt mechanism 22 is fixedly mounted to slide member 42 by means of screws 94. In particular, as shown in FIGS. 6 and 10, each slide element 80, 82 may be provided with a screw hole 96 for receiving a screw 94. It will be appreciated that tilt mechanism 22, or alternately support member 14, may be affixed to slide member 42 by any other securing means known in the art.

Similarly, housing 40 may be affixed to seat 16 by any means known in the art. Preferably, seat support 46 is affixed to seat 16. In the preferred embodiment, seat support 46 is provided with a plurality of arms 98, preferably one at each corner of seat support 46 which extends outwardly and upwardly. The upper extension of each arm 98 is provided with an opening 100 through which a fastener, such as a screw or the like, may be inserted to affix seat 16 to arms 98.

In an alternate embodiment, as shown in FIG. 11, each arm 98 may have a pod 102 provided at the end thereof. Pod 102 is adapted to receive a spacer 104. Each spacer 104 has an upper portion 108 and a lower portion 106. Spacer 104 may be affixed to pod 102 by any means known in the art. For example, spacer 104 may be provided with a central opening therethrough which is provided for receiving a fastener (such as a screw or the like). Thus, a screw may be inserted through upper portion 108, through lower portion 106, to be received in pod 102 to thereby affix spacer 104 to pod 102.

Preferably, upper portion 108 has a bulbus portion 110 positioned above a narrower neck 112. The lower surface of seat 16 is provided with a plurality of openings (not shown), each to receive an upper portion 108 of a spacer 104. The opening in the bottom of seat 16 is preferably sized to be smaller than the diameter of bulbus portion 110. Further, bulbus portion 110 preferably is deformable so that it deforms when it is inserted into the opening in the bottom of seat 16. More preferably, the opening in the bottom of seat 16 has a first portion that is narrow and a second, inwardly positioned portion that is wider so as to allow bulbus portion 110 to expand at least partially therein. Thus, seat 16 may be removably affixed to arms 98 by aligning the openings in the bottom of seat 16 with each spacer 104 and pressing downwardly so as to force each bulbus portion 110 to compress and enter into the respective opening, thus snapping seat 16 onto arms 98. By applying suitable upward pressure on seat 16, 16 may be removed from spacers 104.

It will be appreciated with slide member 42 affixed to tilt mechanism 22 and being movable within housing 40, and with seat 16 mounted to housing 40, seat 16 may move longitudinally (i.e. rearwardly or forwardly) with respect to tilt mechanism 22. Further, by affixing back rest 18 to tilt mechanism 22, as shown in FIG. 1, the position of seat 16 may be moved longitudinally with respect to back rest 18. Since the actual shape of the lower back and upper leg portion of a person varies from individual to individual, the user may adjust the position of seat 16 with respect to back rest 18 to locate an optimal position of seat 16.

In order to assist a person to incrementally adjust the position of seat 16 with respect to back rest 18, and to maintain the respective positions of seat 16 and back rest 18, the chair is provided with adjustment member 44 mounted in housing 40 and drivingly connected to slide member 42 whereby movement of adjustment member 44 in a first direction causes seat 16 to move forwardly and movement of adjustment member 44 in the opposite direction causes seat 16 to move rearwardly. Preferably, adjustment member 44 is rotatably mounted on housing 40 so that the clockwise rotation of adjustment member 44 will move seat 16 in a first longitudinal direction and the counterclockwise location of adjustment member 44 will cause seat 16 to move in the opposite longitudinal direction.

As shown in the drawings, the adjustment member may comprise rack and pinion drive members. In particular, in the preferred embodiment, adjustment member 44 comprises a longitudinally extending shaft 120 which has a control knob 122 positioned at one end thereof and at least one pinion 124 provided adjacent the distal end thereof. Shaft 120 is rotatably mounted in housing 40, for example, by means of upper bearing mount 126 having an upper bearing surface 128 and lower bearing mount 130 having the lower bearing surface 132. When cover plate 48 is mounted to seat support 46, each upper bearing mount 126 is aligned with a respective lower bearing mount 130 such that upper and lower bearing surfaces 128 and 132 provide a support surface along which shaft 120 may rotate.

Plate 74 is provided with a toothed section which is positioned to engage pinions 124. Accordingly, plate 74 may be provided with a rack which is positioned to align with each pinion 124. As shown in FIG. 8, plate 74 has two tongues 134 each of which is provided with a plurality of teeth 136 which are sized and configured to engage the teeth of a respective pinion 124. In order to accommodate pinions 124 in cavity 50, inner surface 70 may be provided with a recessed portion 138 in which upper bearing mounts 126 are affixed. Thus, when slide member 42 is positioned in cavity 50 with slide elements 80, 82 positioned in groves 84, 86 tongues 134 will overly pinions 124. Further, when cover plate 48 is affixed to seat support 46, rotation of control knob 122 will cause pinions 124 to drive plate 74 either forwardly or rearwardly.

In order to prevent accidental adjustment of seat adjustment mechanism 12, seat adjustment mechanism 12 may also be provided with a lock mechanism which has a locked position in which adjustment member 44 is fixed in position and an unlocked position in which adjustment member 44 may be moved to adjust the position of seat 16. Preferably, the locking mechanism comprises a biasing member to bias the locking member to the locked position. The locking mechanism may comprise a first engagement member which is connected to housing 40 and a second engagement member connected to shaft 120 whereby engagement of the first and the second engagement members prevents adjustment member 44 from being rotated.

Referring to the drawings, adjustment member 44 is provided with biasing member 140. Biasing member 140 is affixed to shaft 120 by any means known in the art. For example, shaft 120 may have a washer 142 or the like affixed thereto and biasing member 140 is preferably a member which may resiliently withstand a compressive force, such as a spring. Accordingly, when adjustment member 44 is mounted in housing 40, the spring or the like is compressed between washer 142 and one of the upper bearing mounts 126. The compressive force of the spring causes washer 142, and therefore shaft 120 and knob 122 to move to the transverse outward position with respect to housing 40. As shown in FIGS. 5 and 6, an inward force has been applied via control knob 122 to move shaft 120, and therefore pinions 124, transversely inwardly with respect to housing 40.

Figure 3:
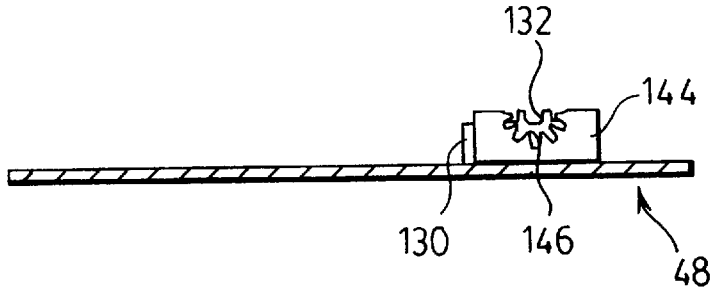
FIG. 3 is a cross section of the cover plate along the line 3—3 in FIG. 2.
Figure 4:
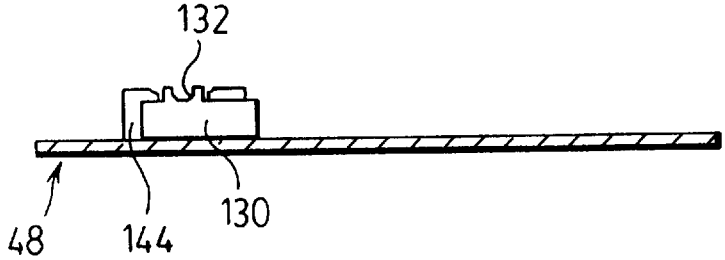
FIG. 4 is cross section of the cover plate along the line 4—4 in FIG. 2.

Cover plate 48 is provided with an abutment member 144 which is positioned and configured to engage a portion of one of the pinions 124 when adjustment member 44 is in the locked position and to be disengaged from pinions 124 when adjustment member 44 is in the unlocked position (as shown in FIG. 5). Preferably, abutment member 144 has a toothed inner surface 146 (see FIG. 3) in which the teeth of pinions 124 may be engaged. It will be apparent that abutment member 144 may be provided on inner surface 70.

Referring to FIG. 6, slide member 42 is shown mounted in seat support 46 with cover plate 48 removed. Tongues 134 extend forwardly over shaft 120. In the unlocked position shown in FIG. 6, tongues 134 are fully aligned with pinions 124 so that pinions 124 are not seen in this bottom plan view. It will be appreciated that if cover plate 48 were affixed to seat support 46, that abutment member 144 would be positioned in the dotted area as shown in FIG. 6 adjacent upper bearing mount 126 and noted as area A. When inward pressure is removed from knob 122, pinions 124 move outwardly such that at least a portion of one of the pinions 124 engages teeth 146 of abutment member 144.

In use, the user may be seated in a chair. At that time, the user may reach down and take hold of knob 122. By pushing inwardly on knob 122, pinions 124 may be moved inwardly so as to be disengaged from abutment member 144. It will be appreciated that while pinions 124 may partially engage teeth 136 of tongues 134 while still in engagement with abutment member 144, the fact that abutment member 144 is affixed to seat support 46 will prevent the user from being able to rotate control knob 122 and thereby adjust the position of seat 16. By pressing inwardly, pinions 124 are disengaged from abutment member 144 and thus knob 122 may be freely rotated clockwise or counterclockwise to longitudinally displace slide member 42. As slide member 42 is affixed to tilt mechanism 22, this longitudinal displacement will in fact cause seat 16 to move forwardly or rearwardly.

When the seat is in the desired position, the user merely releases knob 122. Biasing means 140 causes washer 142 to move outwardly until it engages the side of recess 138. This causes pinions 124 (which are non-rotatably affixed to shaft 120) to move to a position whereby they at least partially engage abutment member 144. Thus, by releasing control knob 122, adjustment member 44 automatically moves to the locked position. Accordingly, it will be appreciated that the locking mechanism of the instant invention is easily operable merely by pushing inward on control knob 122 and also by merely releasing control knob 122. Thus, the position of seat 16 may be adjusted while the user is in fact seated in chair 10 as only one hand is required to operate the seat adjustment mechanism and the locking mechanism.

What is claimed is:

1. A chair comprising:

(a) a longitudinally extending seat having a centrally positioned longitudinally extending axis defining a centre line;

(b) a support member for supporting the seat at an elevated height;

(c) a slide member fixedly mounted to at least one of the seat and the support member and leaving at least one drive portion;

(d) a housing positioned between the seat and the support member and fixedly mounted to the other of the seat and the support member, the housing slidably receiving the slide member, the slide member mounted for longitudinal movement forward and rearward with respect to the housing;

(e) said seat, said housing and said slide member traversing parallel planes during said longitudinal movement;

(f) an adjustment member drivingly connected to the at least one drive portion to apply a drive force to the slide member without the adjustment member applying essentially any rotational force to the slide member;

(g) a chair back connected to one of the slide member and the support member whereby adjustment of the adjustment member causes the seat to move with respect to the chair back; and, (h) a locking mechanism, wherein the adjustment member is movable between a locked position in which the locking mechanism locks the adjustment member and an unlocked position in which the adjustment member is drivingly connected to the seat.

2. The chair as claimed in claim 1 wherein the housing has a plurality of longitudinally extending grooves positioned oil each side of the centre line and the slide member has slide elements, each of which is received in a groove of said housing.

3. The chair as claimed in claim 2 wherein, on each side of the centre line, the slide member has at least one forwardly positioned slide element and at least one rearwardly positioned slide element.

4. The chair as claimed in claim 3 wherein the housing comprises a seat support mounting member and a removable cover, the mounting member and the removable cover defining a cavity in which the slide member is slidably mounted.

5. The chair as claimed in claim 4 wherein each of the mounting member and a removable cover has a plurality of tracks, the tracks of the mounting member substantially aligning with the tracks of the removable cover to define a plurality of pairs of tracks whereby each of the pairs of tracks receives a slide element therein.

6. The chair as claimed in claim 1 wherein the slide member has spaced longitudinally extending portions with one longitudinally extending portion positioned on each side of the centre line and a main body portion fixedly connecting the longitudinally extending portions together, each longitudinally extending portion having a slide element adjacent a forward part thereof and a slide element adjacent a rearward part thereof.

7. The chair as claimed in claim 6 wherein the drive portion includes portions that are positioned on either side of the centre line.

8. The chair as claimed in claim 1 wherein the housing comprises a mounting member and a removable cover, the mounting member and the removable cover defining a cavity in which the slide member is slidably mounted, the adjustment member comprises a shaft and bearing surfaces for rotatably receiving the shaft are provided on each of the mounting member and the removable cover.

9. The chair as claimed in claim 8 wherein the adjustment member further comprises a pinion and the slide member further comprises a rack which is drivenly engaged by the pinion, at least a portion of the rack and at least a portion of the pinion are positioned on either side of the centre line.

10. The chair as claimed in claim 1 wherein the adjustment member is moveable between a first position in which movement of the adjustment member adjusts the position of the seat and a second position in which the seat is fixed in position.

11. The chair as claimed in claim 1 wherein the locking mechanism comprises a biasing member to bias the adjustment member in the locked position.

12. The chair as claimed in claim 1 wherein the locking mechanism comprises a first engagement member connected to the housing, a second engagement member connected to the adjustment member and a biasing member to bias the engagement members in the locked position whereby engagement of the first and second engagement members defines the locked position.

13. The chair as claimed in claim 1 wherein the slide member comprises a rack, the adjustment member comprises a shaft having a pinion, and the locking mechanism comprises a first engagement member connected to the housing whereby engagement of the first engagement member and the pinion defines the locked position.

14. The chair as claimed in claim 13 wherein the pinion moves transversely between the locked and the unlocked positions and the pinion is biased to the locked position by a biasing member.

15. A seat adjustment mechanism mounted to a chair having a longitudinally extending seat and a support member for supporting the seat at an elevated height, the seat adjustment mechanism comprising:

(a) a slide member for receiving thereon at least one of the seat and the support member and having at least one drive portion;

(b) a housing positionable between the seat and the support member for receiving thereon the other of the seat and the support member, the housing having a central axis and a plurality of longitudinally extending grooves for slidably receiving the slide member, the slide member having slide elements which are received in said grooves such that the slide member is mounted for longitudinal movement forward and rearward with respect to the housing;

(c) an adjustment member drivingly connected to the at least one drive portion to apply a drive force to the slide member whereby adjustment of the adjustment member causes the seat to move; and, (d) a locking mechanism, wherein the adjustment member is movable between a locked position in which the locking mechanism locks the adjustment member and an unlocked position in which the adjustment member is rotationally drivingly connected to the seat.

16. The seat adjustment mechanism as claimed in claim 15 wherein, on each side of the central axis, the slide member has at least one forwardly positioned slide element and at least one rearwardly positioned slide element.

17. The seat adjustment mechanism as claimed in claim 16 wherein the housing comprises a mounting member and a removable cover, the mounting member and the removable cover defining a cavity in which thee slide member is slidably mounted.

18. The seat adjustment mechanism as claimed in claim 15 wherein the slide member has spaced longitudinally extending portions with one longitudinally extending portion positioned on each side of the central axis and a main body portion fixedly connecting the longitudinally extending portions together, each longitudinally extending portion having a slide element adjacent a forward part thereof and a slide element adjacent a rearward part thereof.

19. The seat adjustment mechanism as claimed in claim 15 wherein the drive portion includes portions that are positioned on either side of the central axis.

20. The seat adjustment mechanism as claimed in claim 15 wherein the housing comprises a mounting member and a removable cover, the mounting member and the removable cover defining a cavity in which the slide member is slidably mounted, the adjustment member comprises a shaft and bearing surfaces for rotatably receiving the shaft are provided on each of the mounting member and the removable cover.

21. The seat adjustment mechanism as claimed in claim 20 wherein the adjustment member is drivingly connected to the slide member by rack and pinion drive members, at least a portion of the rack and at least a portion of the pinion are positioned on either side of the central axis.

22. The seat adjustment mechanism as claimed in claim 15 wherein the adjustment member is moveable between a first position in which movement of the adjustment member adjusts the position of the seat and a second position in which the seat is fixed in position.

23. A seat adjustment mechanism mounted to a chair having a longitudinally extending seat and a support member for supporting the seat at an elevated height, the seat adjustment mechanism comprising:

(a) a slide member for receiving thereon one of the seat and the support member and having at least one drive portion;

(b) a slide mount positionable between the seat and the support member for receiving thereon the other of the seat and the support member, the slide mount having a mounting member and a removable cover, the mounting member and the removable cover defining a cavity having a central axis and in which the slide member is slidably mounted by a plurality of longitudinally extending grooves positioned on each side of the central axis, the slide member mounted for longitudinal movement forward and rearward with respect to the slide mount;

(c) an adjustment member drivingly connected to the at least one drive portion to apply a drive force to the slide member, the adjustment member being moveable between a first position in which movement of the adjustment member adjusts the position of the seat and a second position in which the seat is fixed in position; and;

(d) a locking mechanism, wherein the adjustment member is movable between a locked position in which the locking mechanism locks the adjustment member and an unlocked position in which the adjustment member is drivingly connected to the seat.

24. The seat adjustment mechanism as claimed in claim 23 wherein, on each side of the central axis, the slide member has at least one forwardly positioned slide element and at least one rearwardly positioned slide element.

25. The seat adjustment mechanism as claimed in claim 23 wherein the slide member has spaced longitudinally extending portions with one longitudinally extending portion positioned on each side of the central axis and a main body portion fixedly connecting the longitudinally extending portions together, each longitudinally extending portion having a slide element adjacent a forward part thereof and a slide element adjacent a rearward part thereof.

26. The seat adjustment mechanism as claimed in claim 25 wherein the drive portion includes portions that are positioned on the main body portion.

27. The seat adjustment mechanism as claimed in claim 23 wherein the adjustment member comprises a shaft and bearing surfaces for rotatably receiving the shaft are provided on each of the mounting member and the removable cover.

28. The seat adjustment mechanism as claimed in claim 23 wherein the adjustment member is drivingly connected to the slide member by rack and pinion drive members, at least a portion of the rack and at least a portion of the pinion are positioned on either side of the central axis.

* * * * *